United States Patent [19]

Spenceley et al.

[11] 4,411,697

[45] Oct. 25, 1983

[54] METAL REFINING PROCESSES

[75] Inventors: Gene D. Spenceley, Stokesley; Brian C. Welbourn, Whitby, both of England

[73] Assignee: British Steel Corporation, London, England

[21] Appl. No.: 388,428

[22] Filed: Jun. 14, 1982

[30] Foreign Application Priority Data

Jun. 19, 1981 [GB] United Kingdom ..... 8118962

[51] Int. Cl.[3] ..... C21C 5/32; C21C 5/34

[52] U.S. Cl. ..... 75/60; 75/52; 75/59

[58] Field of Search ..... 75/60, 59, 52, 51

[56] References Cited

U.S. PATENT DOCUMENTS

| | | | |
|---|---|---|---|
| 2,991,173 | 7/1961 | Trentini | 75/60 |
| 3,854,932 | 12/1974 | Bishop | 75/60 |
| 4,045,213 | 8/1977 | Leroy | 75/59 |
| 4,089,677 | 5/1978 | Spenceley | 75/60 |
| 4,178,173 | 12/1978 | Gorges | 75/60 |
| 4,195,985 | 4/1980 | Brotzmann | 75/60 |
| 4,198,230 | 4/1980 | Brotzmann | 75/60 |
| 4,280,838 | 7/1981 | Marukawa | 75/52 |
| 4,302,244 | 11/1981 | Sieckman | 75/59 |
| 4,304,598 | 12/1981 | von Bogdandy | 75/60 |
| 4,329,171 | 5/1982 | Robert | 75/60 |

FOREIGN PATENT DOCUMENTS

| | | | |
|---|---|---|---|
| 1503496 | 3/1978 | United Kingdom | 75/60 |
| 2003591 | 3/1979 | United Kingdom | 75/60 |
| 1586762 | 3/1981 | United Kingdom | 75/60 |
| 2083078A | 3/1982 | United Kingdom | 75/60 |
| 2083183A | 3/1982 | United Kingdom | 75/60 |

*Primary Examiner*—P. D. Rosenberg

*Attorney, Agent, or Firm*—Bacon & Thomas

[57] ABSTRACT

The invention provides a process for refining steel comprising the steps of blowing a refining gas at the upper surface of the melt contained in a refining vessel by means of an overhead lance; injecting a stirring or processing gas directly into the vessel below the surface level of the melt therein; and introducing carbon from above onto or through the upper surface of the melt in the refining vessel.

12 Claims, 5 Drawing Figures

12
10
11
3
2
1
4

METAL REFINING PROCESSES

This invention relates to a process for refining metal and more particularly to a steel refining process.

According to the invention there is provided a process for refining steel comprising the steps of blowing a refining gas at the upper surface of the melt contained in a refining vessel by means of an overhead lance; injecting a stirring or processing gas directly into the vessel below the surface level of the melt therein; and introducing solid carbonaceous material from above onto or through the upper surface of the melt in the refining vessel.

The refining gas constitutes an oxidising agent and may comprise oxygen as such.

The stirring or processing gas may be introduced via tuyeres, porous bricks, or other gas permeable elements for example.

The stirring or processing gas may be neutral or reducing or can in some instances comprise an oxidising gas, provided that in this instance the corrosive and erosive effects of the gas at the injection positions are taken into account in the choice of injection means (preferably one or more tuyeres protected by a shroud fluid are used). The gas may for example comprise nitrogen, argon or other inert gas, carbon monoxide, carbon dioxide air or oxygen or combinations thereof. Shrouding as aforesaid may be by nitrogen, argon or other inert gas or a hydrocarbon fluid or carbon dioxide, carbon monoxide or combination thereof.

It is to be noted that where the stirring or processing gas is an oxidising gas, the overhead lance will provide at least 60% of the gas for refining.

The source carbonaceous material may be of any convenient kind. Thus, it may comprise anthracite, coal, coke, lignite or other carbon bearing material such as silicon carbide, calcium carbide, or carbon containing industrial by-products such as that known as "silicon carbide coke" for example. The carbonaceous material may be introduced in granular, pellet, lump, briquette or similar form by means of a hopper of the kind normally used for additives to a refining vessel.

Alternatively the carbonaceous material may be blown onto or through the upper surface of the melt in granular or powder form via carrier gas. This blowing may be of sufficient velocity to provide penetration of the material into the melt.

In one embodiment, lance blowing of the carbonaceous material may be by means of a high velocity carrier gas using anthracite. In this embodiment it is intended to achieve the maximum possible carbon penetration of the melt before reaction of the carbon occurs.

Alternatively the blowing may comprise little more than gas assisted flow, for example of particulate or lump feedstock through a supply pipe.

The overhead refining lance or a subsidiary lance may be used for transportation of the carbonaceous material with one of, or a mixture of a variety of carrier gases such as nitrogen, argon, or other inert gas, air, carbon dioxide, or a reducing gas such as hydrogen.

The lance may have a single outlet orifice or a plurality of orifices.

Although most commonly blowing of carbonaceous material by a lance will be from the top opening of the steel refining vessel, as an alternative tuyeres may project through ports in the upper side walls of the vessel.

Provision may be made for the supply of auxiliary or secondary oxidising gas in the vessel above the melt. It is believed that this enables the efficient combustion above the melt of off-gas from the melt, thus emitted carbon monoxide at or above the surface of the melt can be combusted. It is also believed that this provides means for enhancing oxidation reactions in the slag phase where solid carbonaceous material, metal droplets, carbon monoxide, and hydrogen gas may also be present.

In order to improve or maximise assimilation of the carbonaceous material into the melt, the entraining gas may be arranged for a pulsed form of actuation, or a swirling actuation may be arranged to give a required spread of the material over the upper surface of the melt.

With the process of the kind described, the stirring or processing gas where injected into the melt by means of said one or more tuyeres, may at times be used to entrain solid reactants such as lime in powder and granular form for processing purposes. In one embodiment of the invention, additional carbonaceous material may be injected.

The invention includes apparatus for carrying out the process hereinabove specified.

In order that the invention may be more readily understood one embodiment thereof will now be described by way of example with reference to the accompanying drawings in which.

Figure 1:
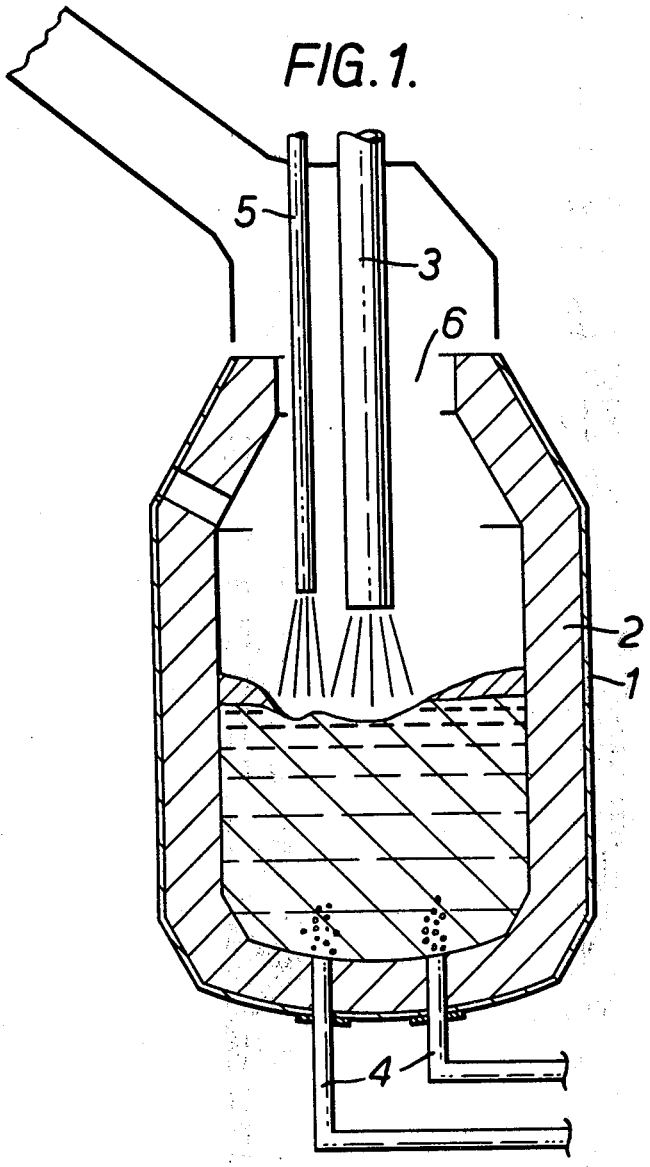
FIG. 1 is a schematic elevation of one embodiment of apparatus for carrying out the method according to the invention.
Figure 2:
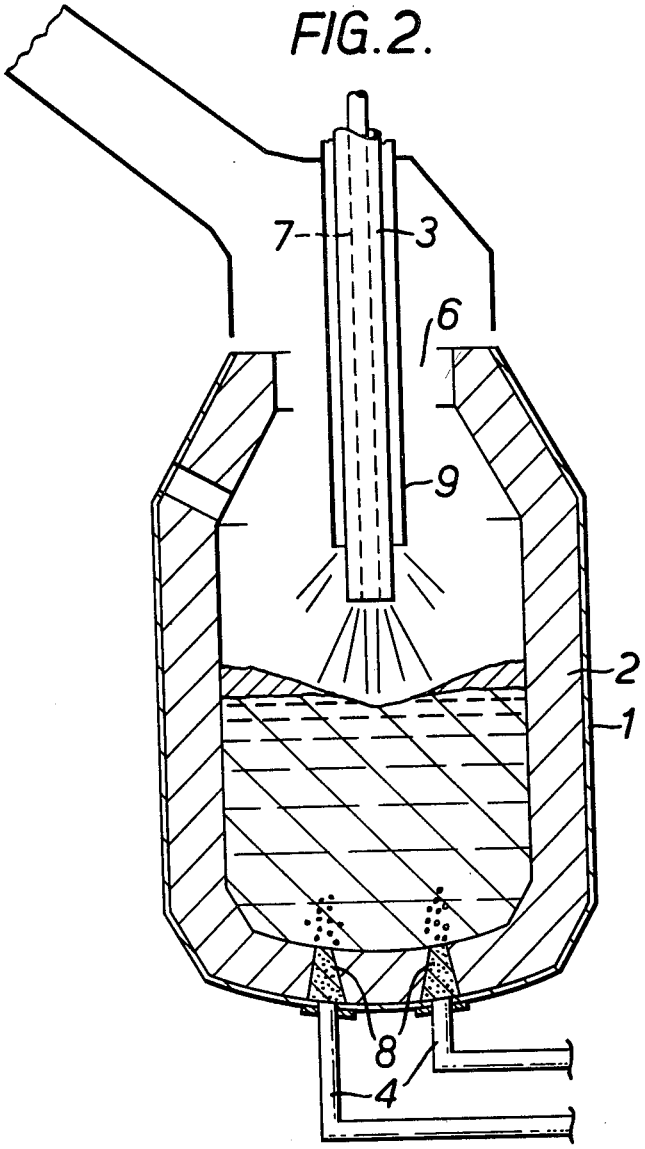
FIG. 2 is a schematic elevation of a second embodiment of apparatus for carrying out the method according to the invention.
Figure 4:
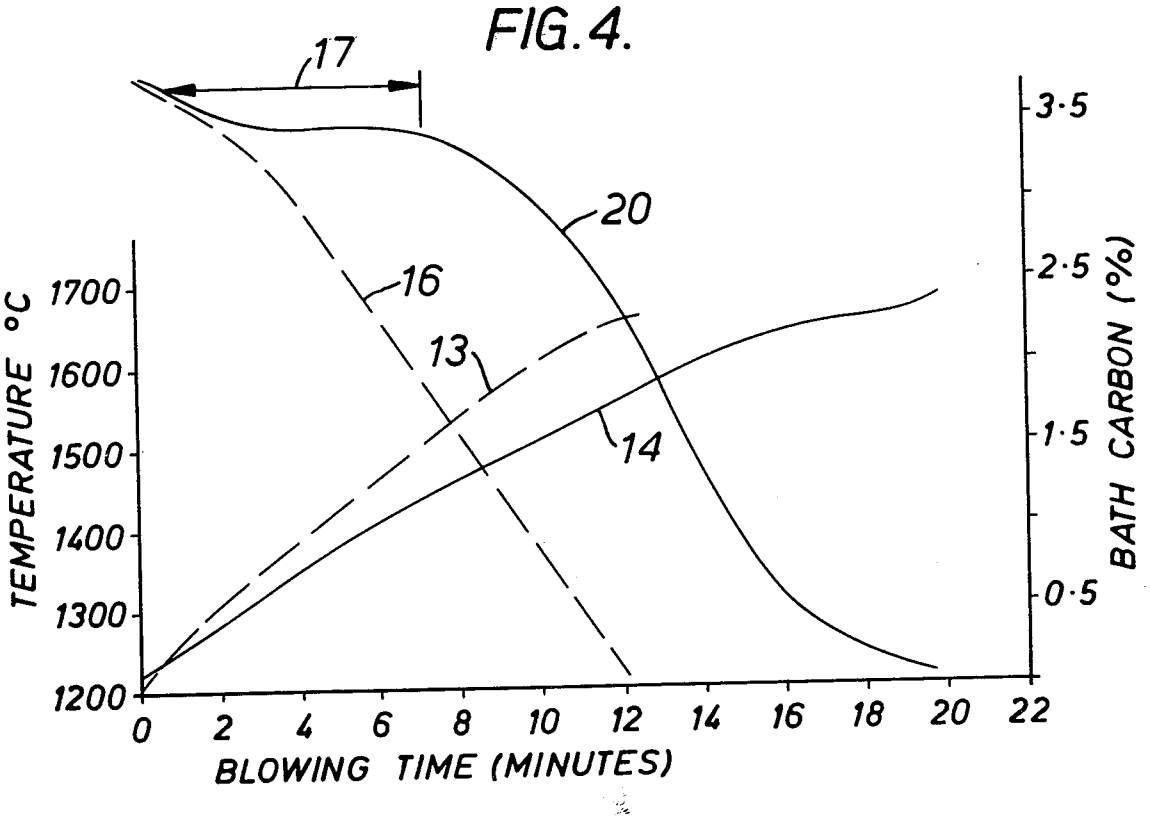
Figure 5:
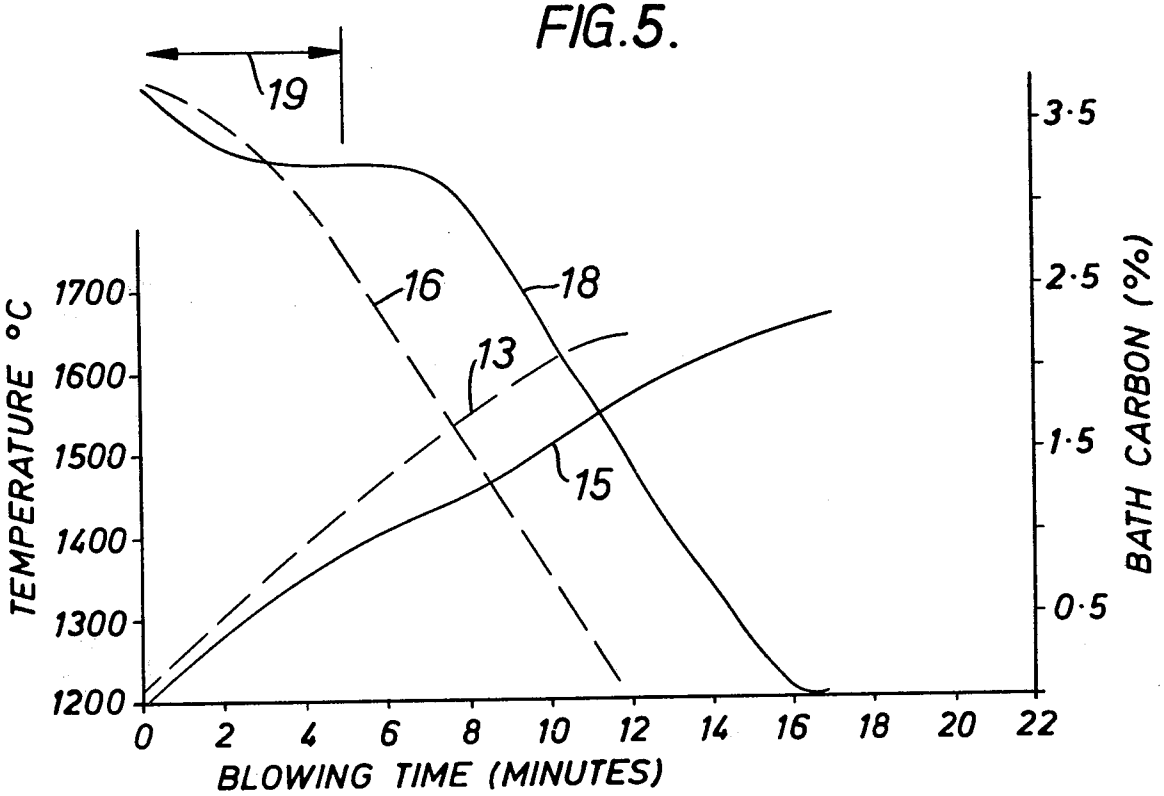

FIG. 4 is a graph illustrating the effects of using an embodiment of the invention similar to that of FIG. 2 referred to above; and FIG. 5 is a graph illustrating the effects of using the third embodiment of the invention referred to above In the embodiment of the invention illustrated in FIG. 1 a three tonne pilot plant converter vessel 1 having a refractory lining 2 is provided with an overhead oxygen refining lance 3. Basal tuyeres 4 are provided for the introduction of a stirring gas for example of argon. A subsidiary lance 5 additionally projects through the upper opening 6 of the converter vessel through which pulverised anthracite is blown, entrained in nitrogen at high velocity. The arrangement is such that maximum penetration of carbon into the bath is achieved prior to reaction of the carbon with the melt. Scrap may be introduced to the refining vessel in batch form prior to the commencement of refining or may be added continuously or in discrete batches during refining.

The arrangement of FIG. 2 is very similar to that of FIG. 1 except that a subsidiary lance 7 for blowing in the carbon is constituted by a central passageway through the refining lance 3, and a sleeve 9 may be provided for the provision of secondary oxygen to the refining lance 3 for the provision of secondary oxygen for combustion above the melt of off gas from the melt. Thus the secondary oxygen combusts with emitted carbon monoxide at or above the surface of the melt, thereby increasing the heat available for scrap consumption. Additionally means may be provided for introducing particulate material such as a carbon source material or lime, into the zone of combustion of carbon monoxide above the melt to increase the luminosity of combustion, thereby increasing the radiant heat available for scrap consumption.

Porous bricks 8 are provided for the supply of the stirring gas to the melt.

Figure 3:
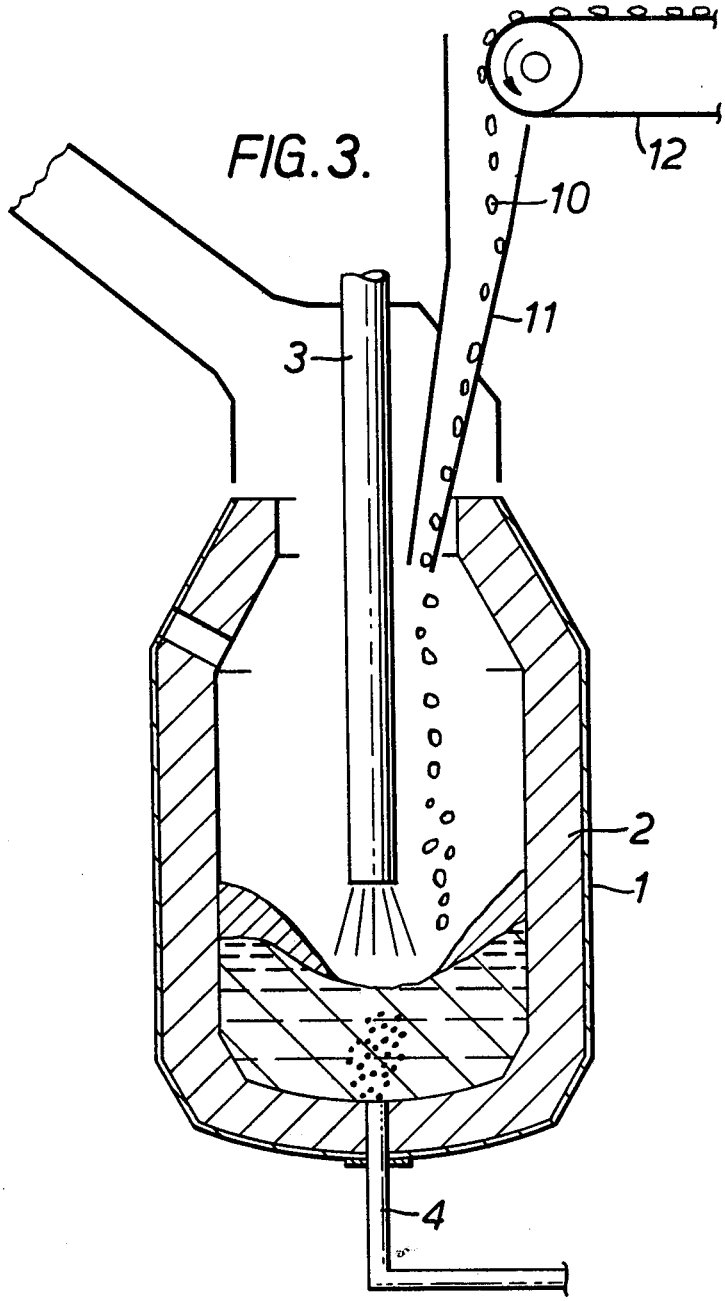
FIG. 3 is a schematic elevation of a third embodiment of apparatus for carrying out the method according to the invention.

Again the arrangement of FIG. 3 is generally similar to that of FIG. 1 except that in this case carbon is supplied in lump form 10, for example lumps of anthracite, via a chute 11 from a belt conveyor 12.

We have found that, for example, with an arrangement similar to that of FIG. 2 scrap consumption in a typical melt can be increased with very efficient utilisation of carbonaceous material.

We consider that this surprising increase of capability for scrap consumption is due to a combination of the overhead introduction of the carbonaceous material in association with the oxidising lance, which enables the provision of good carbon combustion with the combination of stirring from below melt gas injection to provide a considerable recovery of heat. We believe, in an arrangment of the kind illustrated, a significant proportion of the carbon progresses through carbon monoxide stage to carbon dioxide. The proportion can be of the order of up to 20 to 30%.

FIGS. 4 and 5 illustrate particular blow sequences on apparatus similar to that illustrated hereinabove utilising the invention.

In each figure the dotted line 13 illustrates temperature variation during a typical steel comparison refining blow not using the invention but using apparatus corresponding to that illustrated in FIG. 2 without the provision of carbon injection or secondary oxygen, whilst dotted line 16 represents bath carbon variation during the same blow.

The refining blow represented by lines 13 and 16 was with respect to 3030 kg of hot metal, 400 kg of scrap (11.7%) having an end of blow temperature of 1655° C. after 12 minutes.

The start and finish composition was as follows (in percentages):-

| | C | Si | Mr | P | S |
|---|---|---|---|---|---|
| Start | 3.80 | 0.99 | 0.79 | 0.12 | 0.028 |
| Finish | 0.06 | 0.01 | 0.40 | 0.063 | 0.024 |

The refining blow represented by temperature variation line 14 and bath carbon variation line 20 in FIG. 4 utilised apparatus similar to that of FIG. 2 but without the provision of secondary oxygen and involved the lance injection of 60 kg anthracite during the first 5 minutes of the blow as shown at 17 at the same oxygen input rate as the comparison blow mentioned above, 2660 kg of hot metal was used with 650 kg of scrap (19.6%). The end blow temperature was 1685° C. The start and finish composition was as follows(in percentages):-

| | C | Si | Mr | P | S |
|---|---|---|---|---|---|
| Start | 3.74 | 1.07 | 0.81 | 0.11 | 0.029 |

-continued

| | C | Si | Mr | P | S |
|---|---|---|---|---|---|
| Finish | 0.04 | 0.01 | 0.26 | 0.024 | 0.032 |

The refining blow represented by temperature variation line 15 and carbon variation line 18 in FIG. 5 utilised apparatus similar to that of FIG. 3 and involved the addition via a chute of 60 kg of lump anthracite during the first 5 minutes of the blow as shown at 19 at the same oxygen input rate as the comparison blow mentioned above. 2750 kg of hot metal was used with 690 kg of scrap (20.1%) The end of blow temperature was 1670° C.

The start and finish composition was as follows (in percentages):-

| | C | Si | Mr | P | S |
|---|---|---|---|---|---|
| Start | 3.76 | 0.89 | 0.82 | 0.11 | 0.032 |
| Finish | 0.04 | 0.01 | 0.30 | 0.052 | 0.035 |

By means of the invention we provide a surprisingly proficient means of achieving recovery of heat enabling a significant increase in scrap usage.

We claim:

1. A process for refining steel comprising the steps of blowing a refining gas at the upper surface of the melt contained in a refining vessel by means of an overhead lance; injecting a stirring or processing gas directly into the vessel below the surface of the melt therein; and introducing solid carbonaceous material from about onto or through the upper surface of the melt in the refining vessel.

2. A process as claimed in claim 1 wherein the stirring or processing gas is an inert gas.

3. A process as claimed in claim 1 wherein the solid carbonaceous material comprises a coal or coke.

4. A process as claimed in claim 3 wherein the solid carbonaceous material cmprises an anthracite.

5. A process as claimed in claim 1 wherein the solid carbonaceous material comprises a carbon containing compound.

6. A process as claimed in claim 1 wherein the solid carbonaceous material comprises a carbon containing industrial by-product.

7. A process as claimed in claim 1 wherein the solid carbonaceous material is introduced to the melt by means of a hopper chute.

8. A process as claimed in claim 1 wherein solid carbonaceous material is introduced to the melt by means of a pipe with gas assistance.

9. A process as claimed in claim 1 wherein solid carbonaceous material is introduced to the melt in granular or powder form in a carrier gas blowing with sufficient velocity to provide penetration of the material into the melt.

10. A process as claimed in claim 9 wherein a subsidiary lance is used for the carbonaceous material injection.

11. A process as claimed in claim 9 wherein a passage of the refining lance is used for the carbonaceous material injection.

12. A process as claimed in claim 1 wherein auxiliary or secondary oxidising gas is supplied above the melt in the vessel.

* * * * *